US006047150A

United States Patent [19]

Kanno et al.

[11] Patent Number: 6,047,150

[45] Date of Patent: Apr. 4, 2000

[54] DEVELOPING CARTRIDGE HAVING COVER MEMBER

[75] Inventors: Kazuhiko Kanno, Numazu; Tachio Kawai, Odawara; Susumu Nittani, Shizuoka-ken, all of Japan

[73] Assignee: Canon Kabushiki Kaisha, Tokyo, Japan

[21] Appl. No.: 09/191,125

[22] Filed: Nov. 13, 1998

[30] Foreign Application Priority Data

Nov. 17, 1997 [JP] Japan ..... 9-332496

[51] Int. Cl.[7] ..... G03G 15/04

[52] U.S. Cl. ..... 399/119; 399/103

[58] Field of Search ..... 399/103, 119, 399/227, 228, 234

[56] References Cited

U.S. PATENT DOCUMENTS

| | | | |
|---|---|---|---|
| 4,460,267 | 7/1984 | Ogawa | 399/119 |
| 4,800,411 | 1/1989 | Tanaka et al. | 399/103 |
| 5,353,098 | 10/1994 | Lim | 399/119 |
| 5,585,598 | 12/1996 | Kasahara et al. | 399/227 |
| 5,809,380 | 9/1998 | Katakabe et al. | 399/227 |
| 5,887,227 | 3/1999 | Kawai et al. | 399/98 |

*Primary Examiner*—Robert Beatty

*Attorney, Agent, or Firm*—Fitzpatrick, Cella, Harper & Scinto

[57] ABSTRACT

The present invention provides a developing cartridge attachable to and detachable from a main body of an image forming apparatus comprising a cartridge frame, developing device for developing a latent image formed on an image bearing member, and a shutter member supported by the cartridge frame. The shutter member moves between a covering position for covering a portion exposed from the cartridge frame of the developing device and a retreat position retreated from the covering position. A sheet member, being flexible and interlocking with the shutter member, covers a part of the cartridge frame when the shutter member moves to the covering position. The cover member covers the gripping portion of the frame and a floating developer regulating member.

13 Claims, 14 Drawing Sheets

DEVELOPING CARTRIDGE HAVING COVER MEMBER

BACKGROUND OF THE INVENTION

1. Field of the Invention

The present invention relates to a developing cartridge attachable to and detachable from an image forming apparatus body, and to an image forming apparatus.

Note that the image forming apparatus includes an electrophotographic copier, an electrophotographic printer (e.g., a laser beam printer and an LED printer), a facsimile apparatus and a wordprocessor etc.

2. Related Background Art

As a construction of an apparatus for forming a multicolor image based on an electrophotographic system, there has hitherto been proposed a method of obtaining the multicolor image by forming a latent image through a selective exposure to a drum-like electrophotographic photosensitive body (which is hereinafter referred to as a photosensitive drum) uniformly charged by a charging device, disposing a plurality of developing cartridges containing developers each assuming a different color on rotation selecting mechanism, developing while making the developing cartridge containing developer of a predetermind color assuming the predetermined color face to the photosensitive drum, transferring this developed image onto a recording medium, and further executing a developing and transferring process with respect to each color.

What has been utilized in recent years is that a drum cartridge structured to integrally include the photosensitive drum, a charging device and a cleaning member and so on defined as expendable units, and a developing cartridge accommodating developers and a developing unit, are so constructed as to be attachable to and detachable from the image forming apparatus, thus facilitating a user's maintenance operation such as replacing the parts.

In the above construction, however, when the development is effected or when the developing cartridge is moved by a rotation selecting mechanism, the floating developers within the image forming apparatus body might be adhered to the developing cartridge to contaminate it in some cases. Hence, there might arise a possibility in which the user, when performing the maintenance operation such as replacing the developing device, has to replace the developing cartridge adhered with the developers.

SUMMARY OF THE INVENTION

It is a primary object of the present invention to enhance an operability when a user performs a maintenance operation such as replacing a developing cartridge.

It is another object of the present invention to provide a developing cartridge enabling the user to perform the maintenance operation such as replacing the developing cartridge from the image forming apparatus without his hands and clothes being contaminated with developers adhered to the developing cartridge, and an electrophotographic image forming apparatus which the developing cartridge can be attached to and detached from.

To accomplish the above objects, according to one aspect of the present invention, a developing cartridge attachable to and detachable from a main body of an image forming apparatus comprises a cartridge frame, a developing unit for developing a latent image formed on an image bearing member (carrier), a shutter member supported by the cartridge frame and movable between a covering position for covering a portion, exposed from the cartridge frame, of the developing unit, and a retreat position retreated from the covering position, and a flexible sheet member, interlocking with the shutter member, for covering a part of the cartridge frame when the shutter member moves to the covering position.

These together with other objects and advantages which will be subsequently apparent, reside in the details of construction and operation as more fully hereinafter described and claimed, reference being had to the accompanying drawings forming a part hereof, wherein like numerals refer to like parts throughout.

Other objects and advantages of the present invention will become apparent during the following discussion in conjunction with the accompanying drawings.

DESCRIPTION OF THE PREFERRED EMBODIMENTS

Given next is an explanation of a developing cartridge in embodiments of the present invention and an electrophotographic image forming apparatus which this cartridge is attachable to and detachable from.

Embodiment 1

To start with the image forming apparatus in an embodiment 1 of the present invention will hereinafter be described with reference to FIGS. 1 to 11.

[Explanation of Whole Image Forming Apparatus]

Figure 1:
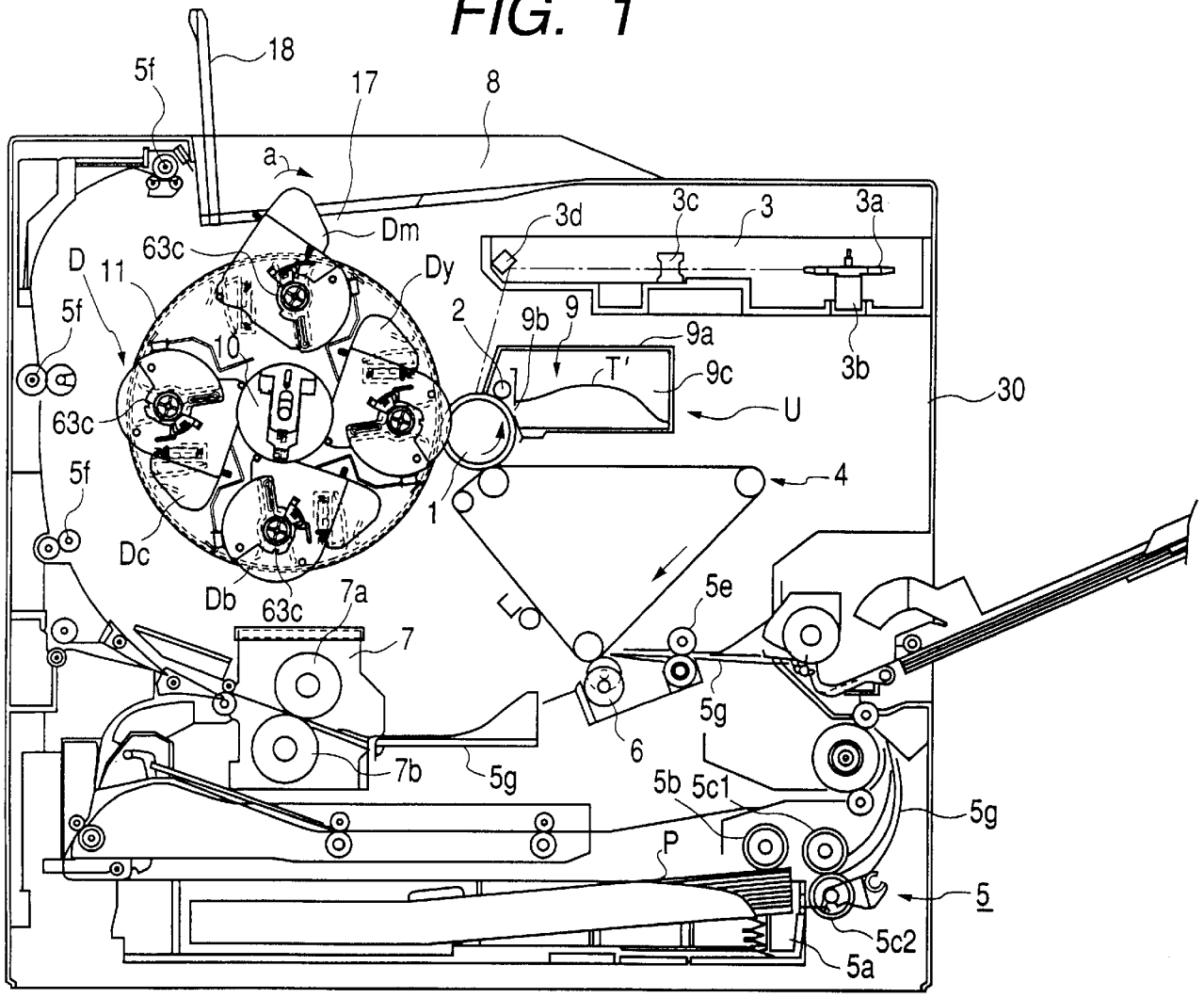
FIG. 1 is a front sectional view showing principal portions of a developing cartridge and an apparatus body for carrying out (working) the present invention.

To begin with, an outline of a whole construction of a color image forming apparatus is explained referring to FIG. 1.

FIG. 1 is an explanatory view showing a whole construction of a laser printer as one form of the color image forming apparatus.

The color laser printer includes a photosensitive drum 1 which rotates at a constant velocity, an image forming portion constructed of four rotatable developing cartridges D, and an intermediate transfer body 4 for holding a color image developed and subjected to a multi-transfer process and further transferring the image onto a transfer material P fed by a conveying means 5 from a sheet feeding portion. The transfer material P, onto which the color image is transferred from the intermediate transfer body 4, is conveyed subsequently to a fixing portion 7, wherein the color image is fixed onto the transfer material P. The transfer material P is discharged by a discharge roller 5*f* to a discharge portion 8 disposed an upper surface of the apparatus. Note that the rotatable developing cartridges D are each so constructed as to be attachable to and detachable from the printer body.

Next, constructions of the respective portion of the image forming apparatus will be sequentially explained in greater details.

[Photosensitive Drum Unit]

A drum unit U is integrally constructed of the photosensitive drum 1, and a container 9*a* of a cleaning device serving as a holder of the photosensitive drum 1. Then, this drum unit U is so supported in the printer body as to be attachable to and detachable from the printer body, and constructed so that the unit U can be easily replaced corresponding to a lifetime of the photosensitive drum 1.

The photosensitive drum 1 in the embodiment 1 is constructed in such a way that an organic photoconductive layer is coated over an outer periphery of an aluminum cylinder which is approximately 50 mm in diameter. The drum 1 is rotatably supported in the container 9*a* of the cleaning device serving as the holder of the photosensitive drum 1. Disposed on the periphery of the photosensitive drum 1 are a cleaning blade 9*b* for removing a developer (toners) remaining on the photosensitive drum 1, and a primary charging means 2 for uniformly charging the surface of the photosensitive drum 1. A driving force of an unillustrated drive motor is transmitted to one end on the rear side in FIG. 1, thereby rotating the photosensitive drum 1 counterclockwise in FIG. 1 corresponding to an image forming operation.

[Charging Unit]

The charging means 2 involves the use of a contact charging method by which a conductive roller is brought into contact with the photosensitive drum 1, of which the surface is uniformly charged with the electricity by applying a voltage to the conductive roller.

[Exposing Unit]

The photosensitive drum 1 is exposed to the light from a scanner portion 3. To be specific, when an image signal is given to a laser diode, this laser diode irradiates a polygon mirror 3*a* with image light corresponding to the image signal.

This polygon mirror 3*a* is rotated at a high speed by a scanner motor 3*b*, and the surface of the photosensitive drum 1 rotating at the fixed velocity is selectively exposed to the image light through an image forming lens 3*c* and a reflecting mirror 3*d*, which is reflected by the polygon mirror 3*a*. As a result, an electrostatic latent image is formed on the photosensitive drum 1.

[Developing Unit]

A developing unit is constructed of four developing cartridges Dy, Dm, Dc, Db by which color developments of yellow, magenta, cyan and black can be attained in order to make the electrostatic latent image visible.

Figure 2:
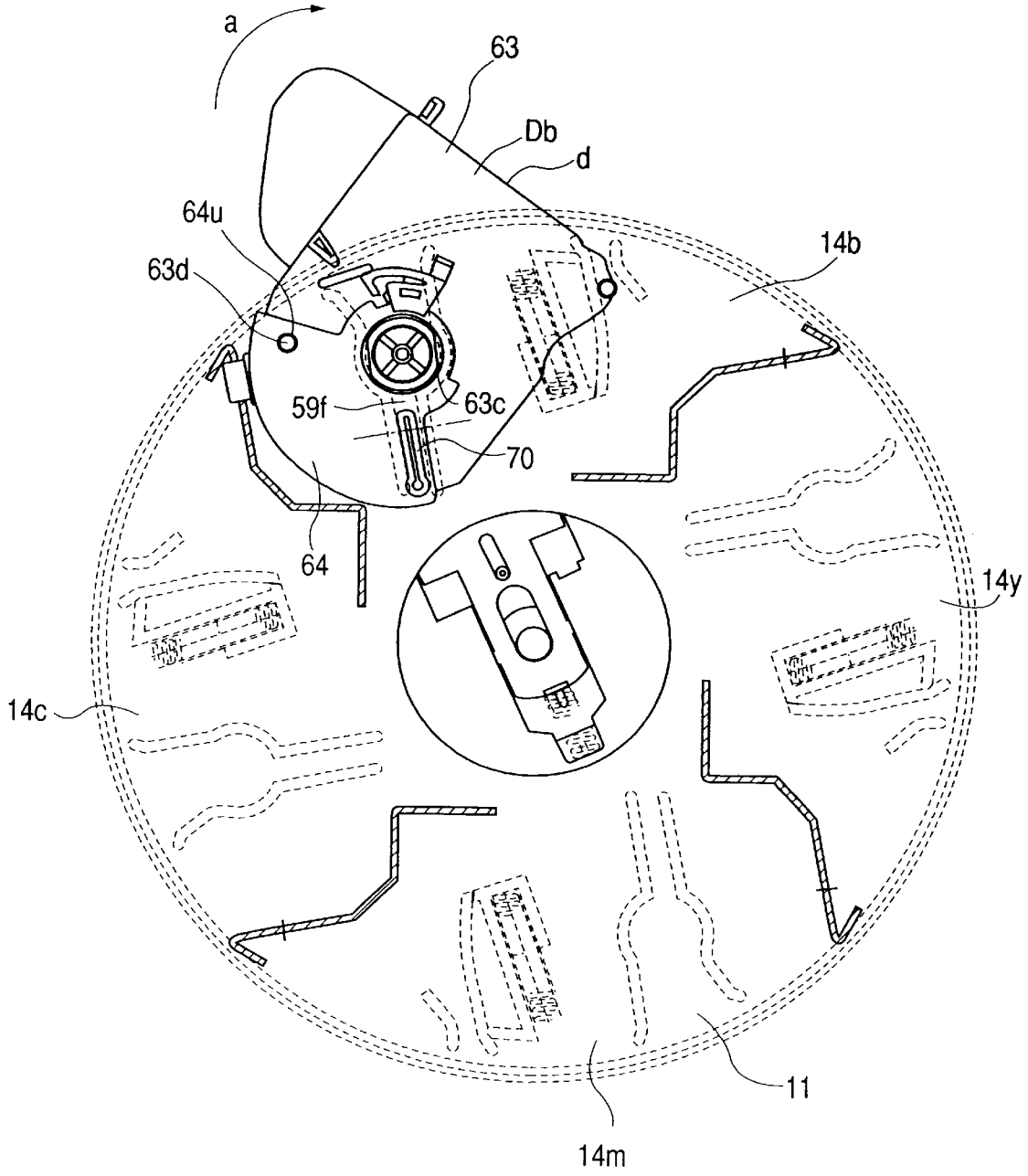
FIG. 2 is a front view showing a rotary unit for carrying out the present invention.
Figure 3:
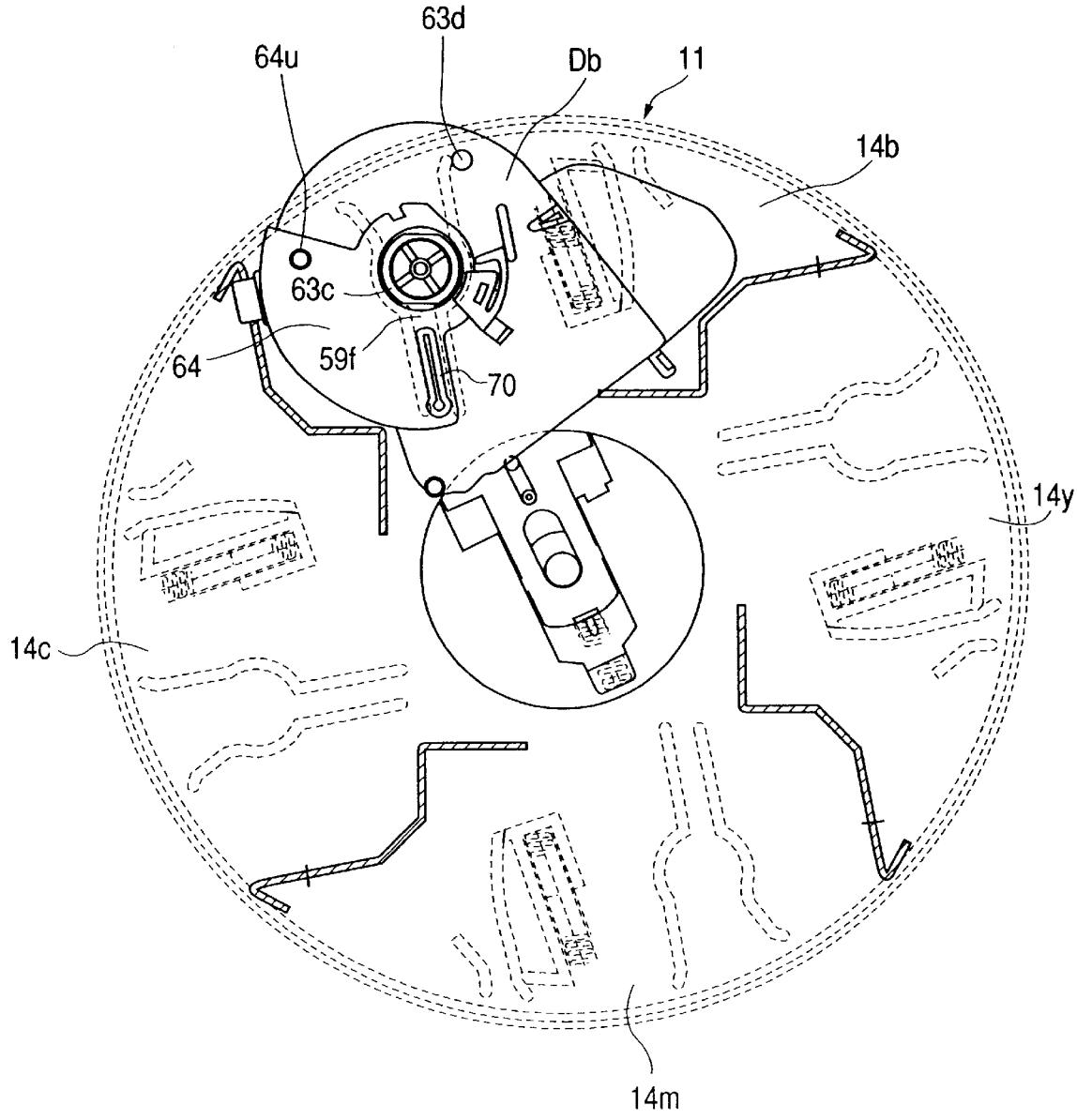
FIG. 3 is a front view showing the rotary unit for carrying out the present invention.

The developing cartridges D are each, as illustrated in FIGS. 1 to 3, so held by a rotary unit 11 rotating about the shaft as to be attachable and detachable therefrom. When forming the image, each developing cartridge D rotationally moves about the shaft in a state being held by the rotary unit 11. The predetermined developing cartridge D halts at a position facing to the photosensitive drum 1, and a development roller which will be mentioned later on is so positioned as to face at a minute spacing (approximately 300 $\mu$m) to the photosensitive drum 1. Thereafter, visible image corresponding to the electrostatic latent image on the photosensitive drum 1 is formed.

When forming a color image, the rotary unit 11 makes one rotation per rotation of the intermediate transfer body 4, and developing processes are executed in the sequence of the yellow developing cartridge Dy, the magenta developing cartridge Dm, the cyan developing cartridge Dc, and finally the black developing cartridge Db.

Figure 4:
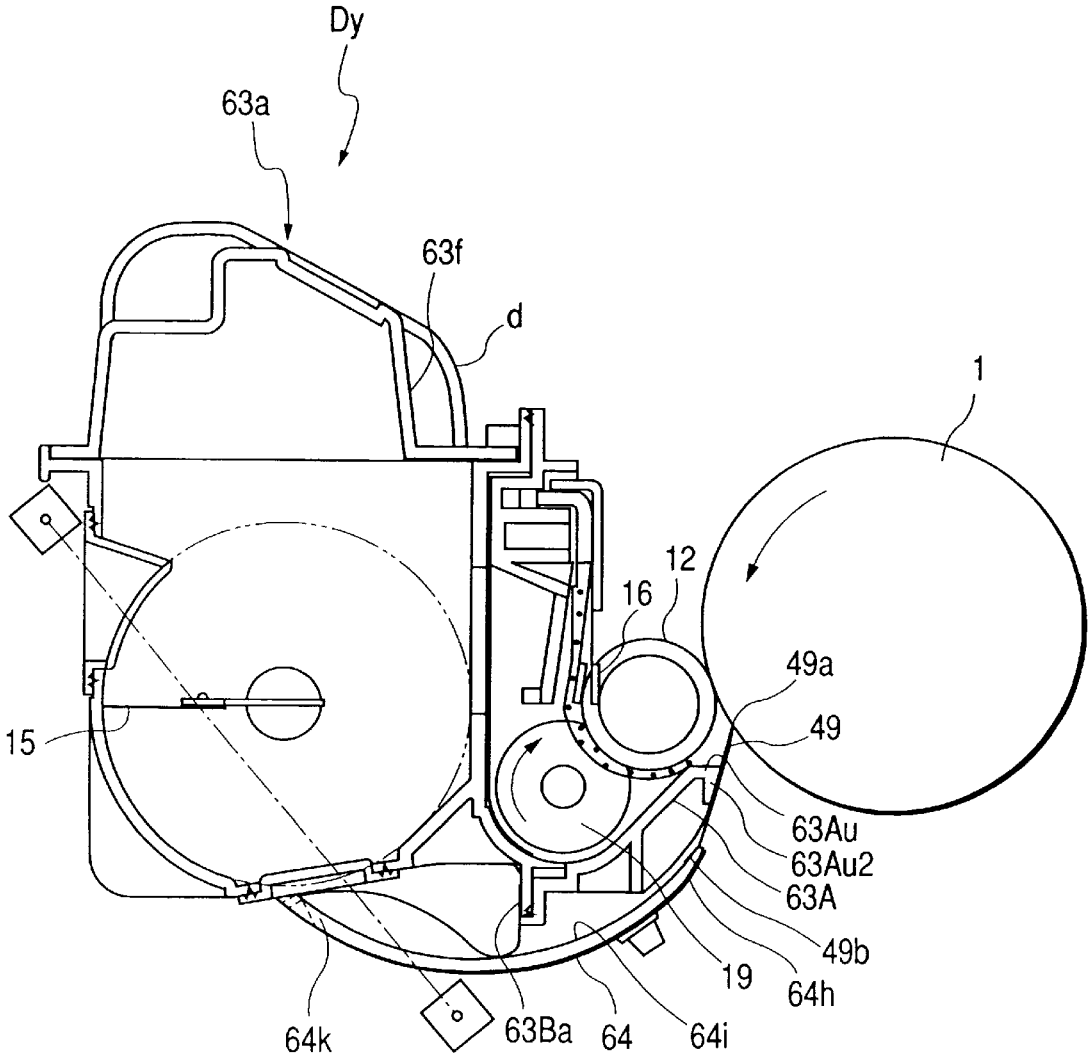
FIG. 4 is a principal vertical sectional view showing a color developing cartridge for carrying out the present invention.

FIG. 4 shows a state where the yellow developing cartridge Dy is positioned and stationary in a position facing to the photosensitive drum unit U. The yellow developing cartridge Dy fed the toners in a toner container 63*a* by a feeding mechanism 15 to a toner supply roller 19. The toners are coated thin over the outer periphery of the development roller 12 rotating clockwise as shown in FIG. 4 by the toner supply roller 19 rotating clockwise as shown in FIG. 4 and a development blade 16 pressfitted to the outer periphery of the development roller 12, and are charged with the electricity (frictional charging).

Then, a development bias is applied to the development roller 12 facing to the photosensitive drum 1 formed with the latent image, thereby toner development is effected on the photosensitive drum 1 corresponding to the latent image. The toner development is conducted by the same mechanism with respect to the magenta developing cartridge Dm, the cyan developing cartridge Dc and the black developing cartridge Db.

Further, each of the development rollers 12 of the individual developing cartridges D is, when each developing cartridge is rotationally moved to the developing position, connected to a driving source (not shown) and high-voltage power source for each color development provided in the printer body 30, then a voltage is sequentially selectively applied per color development, and the driving source is thus connected.

The construction, illustrated in FIG. 4, of the yellow developing cartridge Dy is the same as the magenta and cyan developing cartridges Dm, Dc, of which details are not shown. Each of these color developing cartridges Dy, Dm, Dc includes the toner supply roller 19 having the peripheral surface moving in a direction opposite to the peripheral surface of the development roller 12, the roller 19 being provided rotatably with respect to a developing member support frame 63A of a cartridge frame 63.

Figure 5:
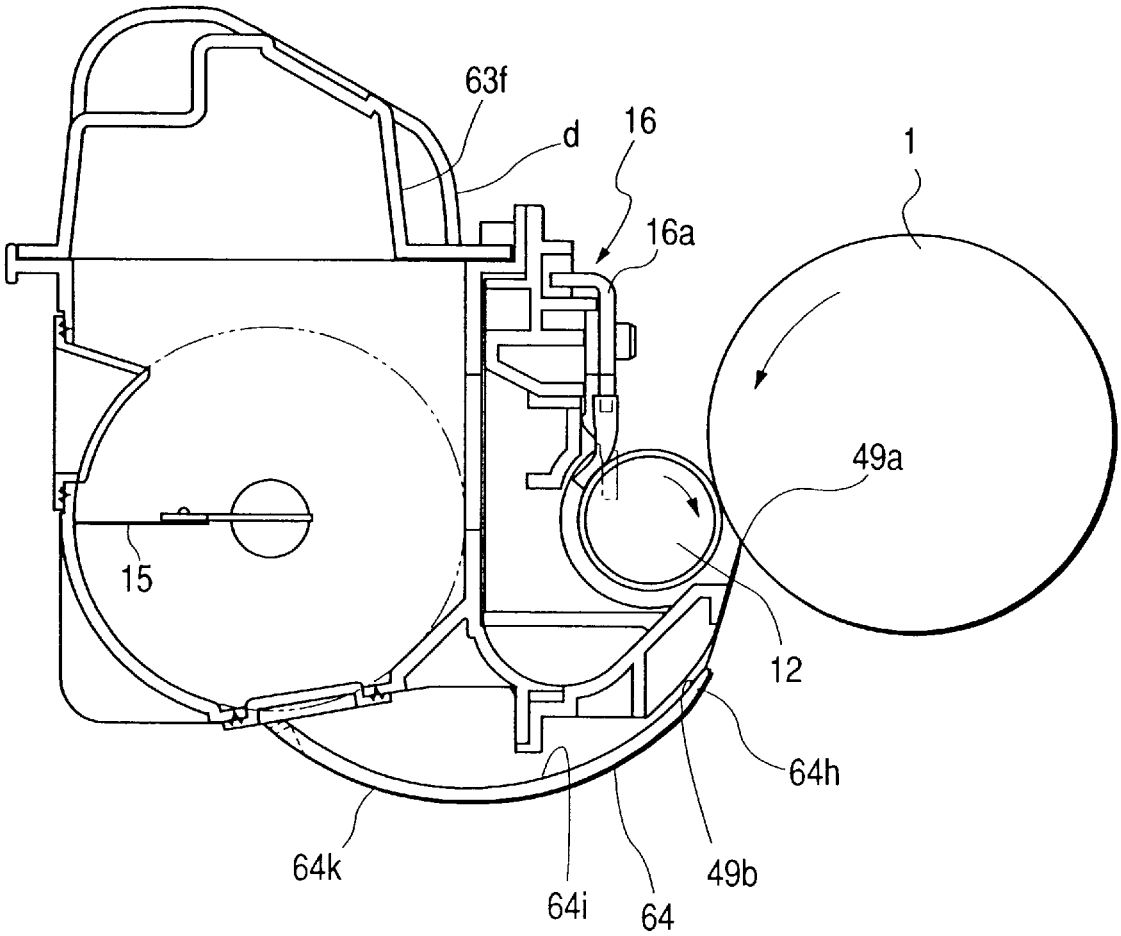
FIG. 5 is a principal vertical sectional view showing a black developing cartridge for carrying out the present invention.

The black developing cartridge Db shown in FIG. 5 does not have the toner supply roller. Then, the toners are adhered to the development roller 12 by a magnetic force and adhesion force. A thickness of toner layer is regulated by the development blade 16 contacted with the peripheral surface of the development roller 12, and the frictional electric charges occur in the toners.

[Intermediate Transfer Body]

The intermediate transfer body 4 is a belt device of which an endless dielectric belt is wound on a pulley. When in the color image forming process, the intermediate transfer body 4 rotates clockwise as indicated by an arrow in FIG. 1 synchronizing with an outer peripheral speed of the photosensitive drum 1 in order to receive four times the multi-transfers (which implies four color images of Y, M, C and Bk) of the toner image on the photosensitive drum 1 which is made visible by each developing unit. Further, the intermediate transfer body 4 subjected to the multi-transfers sandwiches the transfer material P with the transfer roller 6 to which the voltage is applied, and conveys the transfer material P, whereby the respective toner images on the intermediate transfer body 4 are simultaneously multi-transferred onto the transfer material P.

[Cleaning means]

The cleaning means 9, after the toner made visible on the photosensitive drum 1 by the developing means have been transferred onto the intermediate transfer body 4, cleans off the toners remaining on the photosensitive drum 1. Disposal toners T' cleaned off are accumulated in a cleaning container 9*c*. It never happens that a quantity of the disposal toners T' accumulated in the cleaning container 9*c* increases to make the cleaning container 9*c* full of the disposal toners before the lifetime of the photosensitive drum 1 expires. Accordingly, the cleaning container 9*c* is replaced and disposed together with the photosensitive drum 1 simultaneously when the drum 1 is replaced due to the expiration of its lifetime.

[Sheet Feeding Portion]

The conveying means 5 structurally starting with the sheet feeding portion feeds the transfer material P to the image forming portion, and is constructed mainly of a cassette 5*a* contained the plurality of transfer material P therein, a sheet feeding roller 5*b*, a feeding roller 5*c*1, a retard roller 5*c*2 for preventing a double-feed, a sheet feeding guide 5*g* and a resist roller 5*e*.

During the image forming process, the sheet feeding roller 5*b* is rotationally driven corresponding to the image forming process, and separately feeds singly the transfer material P in the sheet feeding cassette 5*a*. The transfer material P arrives at the resist roller 5*e* via the feeding roller 5*c*1 while being guided by the sheet feeding guide 5*g*.

During the image forming process, the resist roller 5*e* performs, in a predetermined sequence, a non-rotation process of making the transfer material P stationarily stand by and a rotation process of conveying the transfer material P toward the intermediate transfer body 4, and aligns the transfer material with the image in the transfer process which is the next process.

[Transfer portion]

A transfer portion is constructed of a rockable transfer roller 6 composed of a metal shaft wound with an intermediate resistance foaming elastic member and so driven as to be movable up and down as shown in the Figure.

The four-color toner images are formed on the intermediate transfer body 4, i.e., the intermediate transfer body 4 makes a plurality of rotations, during which the transfer roller 6 is located downward as indicated by the solid line in the Figure and disposed away from the intermediate transfer body 4 so as not to disturb the images.

Then, after finishing the formations of the four-color toner images on the intermediate transfer body 4, the transfer roller 6 is pressed by an unillustrated cam member in an upper position shown by the thin line in the Figure, i.e., pressed against the intermediate transfer body 4 via the transfer material P. to the transfer roller 6, whereby the toner images on the intermediate transfer body 4 are transferred onto the transfer material P.

Herein, the intermediate transfer body 4 and the transfer roller 6 are respectively driven, and hence the transfer material P sandwiched therebetween is conveyed at a predetermined velocity in the left direction in the Figure simultaneously with the execution of the transfer process, and thus sent toward the fixing portion 7 to receive the next process.

[Fixing portion]

The fixing portion 7 transfers the toner images formed by the developing unit onto the transfer material P via the intermediate transfer body 4, and fixes the transferred toner images. The fixing portion 7 is constructed of a fixing roller 7*a* for applying heat to the transfer material P, and of a pressurizing roller 7*b* for pressfitting the transfer material P to the fixing roller 7*a*. Each of the rollers 7*a*, 7*b* is a hollowed roller, includes a heater inside, and is rotationally driven as well as being so constructed as to simultaneously convey the transfer material P.

Namely, the transfer material P holding the toner images is conveyed by the fixing roller 7*a* and the pressurizing roller 7*b*, and receives the heat and the pressure, whereby the toner is fixed onto the transfer material P.

[Mounting of Developing Cartridge into Image Forming Apparatus Body]

Next, mounting or setting of the developing cartridge will be explained.

At first, an unillustrated button of the printer body 30 is pressed, whereby the rotary unit 11 rotates about a shaft 10 and stops at a predetermined position where a color developing cartridge D being desired to mount can be mounted.

Next, a cover 18 of a developing cartridge insertion port 17 formed in a part of the printer body 30, is opened. Note that the insertion port is normally closed by the cover 18.

As illustrated in FIG. 2, a guide rib 70 provided on a side surface of a shutter 64 (of which details are explained later on) of the developing cartridge D, is adjusted to a cartridge guide 59*f* provided on an inner wall of the rotary unit 11 of the printer body 30, and the developing cartridge D is inserted by pushing the cartridge D. Then, a knob (gripper) recessed portion 63*f* (see FIG. 7) integrally provided with the cartridge frame 63A of the developing cartridge D is pressed by a hand in a direction indicated by an arrow a in FIG. 1, with the result that only the development unit d rotates while the shutter 64 is fixed to the rotary unit 11, and the developing roller 12 appears, thus becoming a possible-of-development state (see FIG. 5).

[Shutter]

Figure 6:
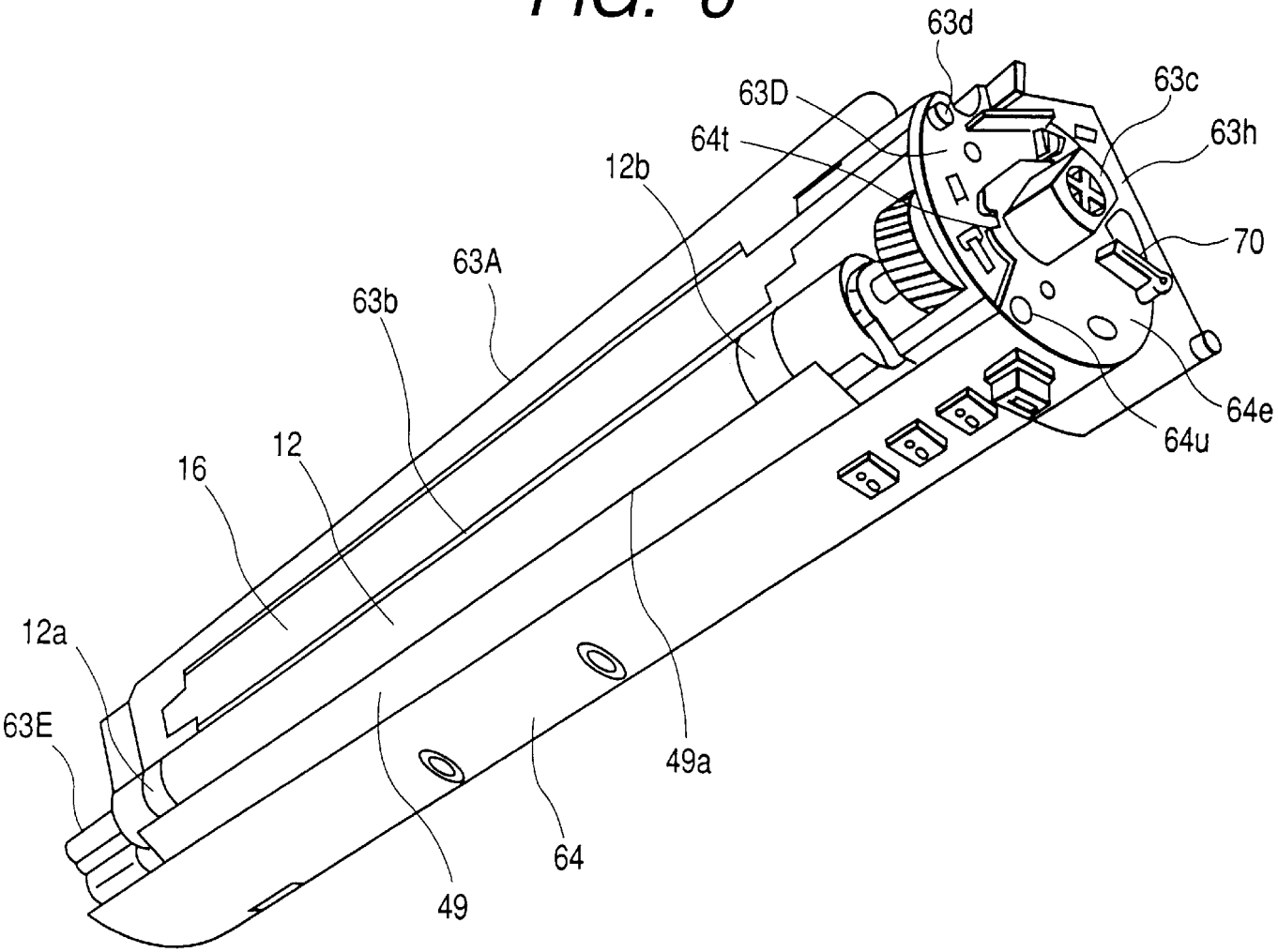
FIG. 6 is a perspective view showing a developing cartridge for carrying out the present invention.
Figure 7:
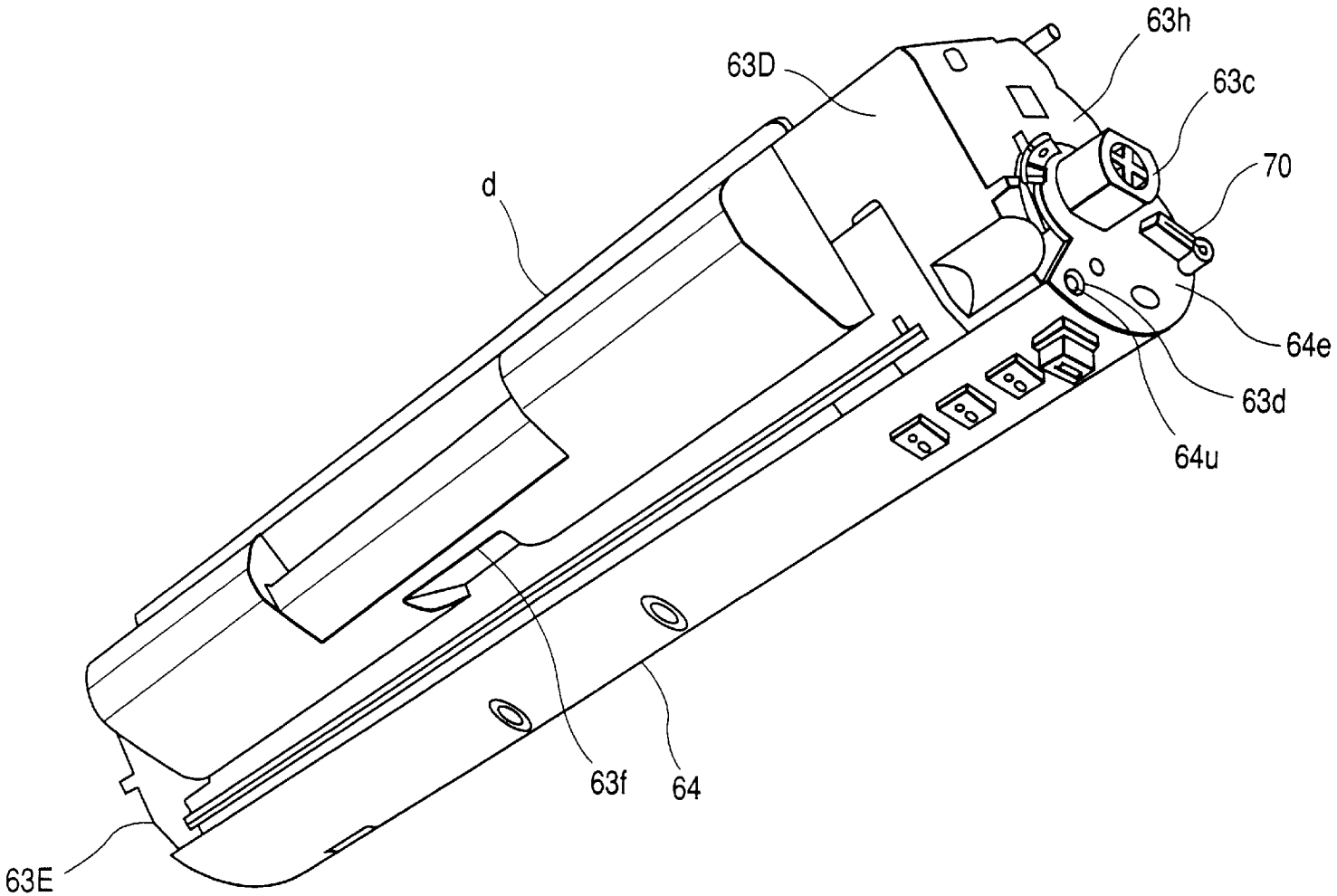
FIG. 7 is a perspective view showing the developing cartridge for carrying out the present invention.

Next, the shutter 64 of the developing cartridge D is described with reference to FIGS. 6 to 8.

Figure 8:
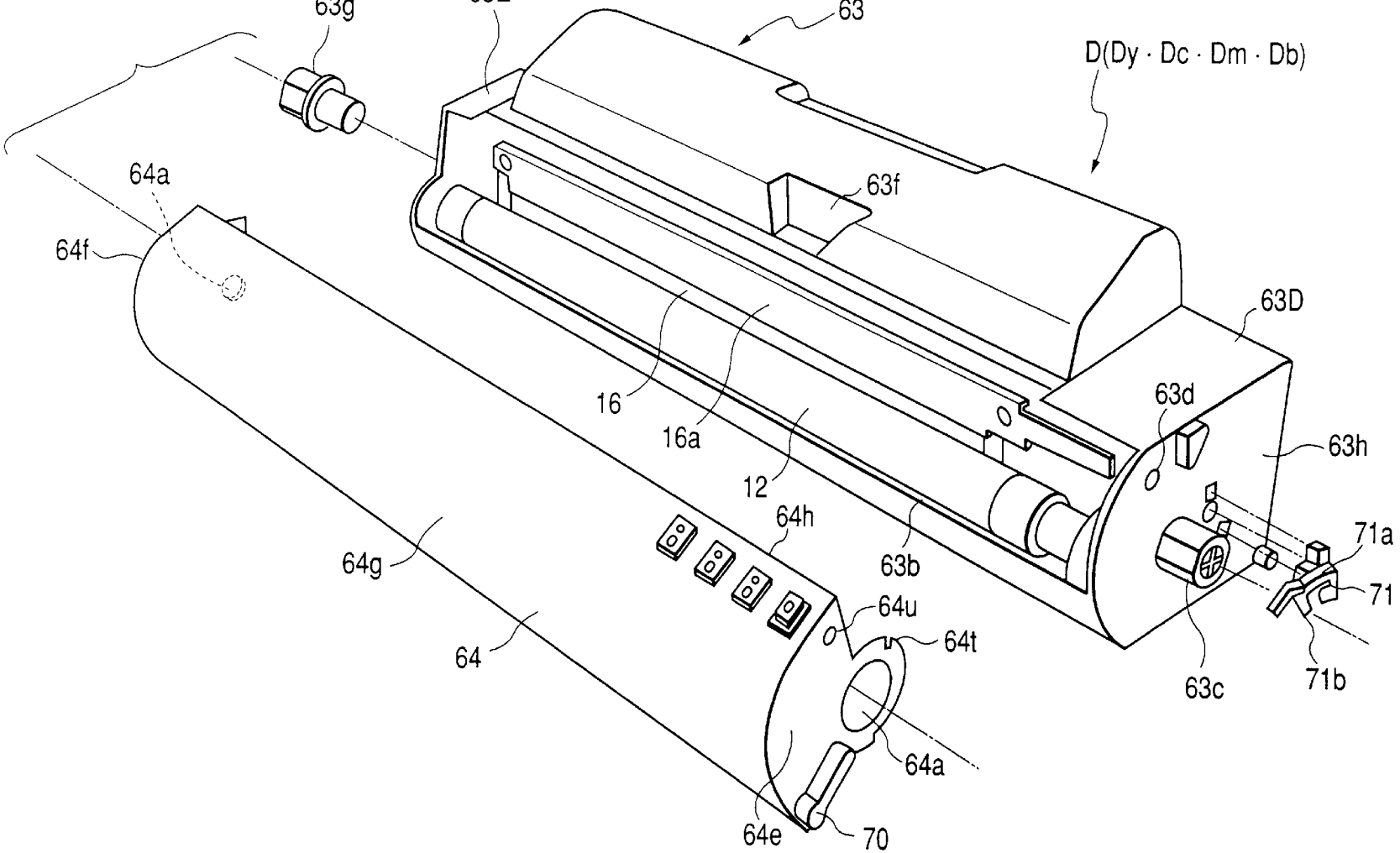
FIG. 8 is an exploded perspective view showing the developing cartridge for carrying out the present invention.

As illustrated in FIG. 8, circular holes 64*a* are formed in side walls 64*e*, 64*f* at both edges, in the longitudinal direction, of the shutter 64 of the developing cartridge D. These circular holes 64*a* are fitted in protrusions 63*c*, 63*g* whereby the shutter 64 is rotatably fitted to the cartridge frame 63. Then, as shown in FIGS. 6 and 7, the shutter 64 is movable between a cover position in which the developing roller 12 is covered, and to a retreat position in which the roller 12 is exposed. The shutter 64 remains closed in a state where the developing cartridge D is detached from the printer body 30. Accordingly, when the developing cartridge D is in an unused state, the developing roller 12 is neither adhered with dust, etc nor damaged.

Further, as illustrated in FIG. 8, a lock member 71 for locking the shutter 64 in the closed state is provided in the vicinity of the protrusion 63*c* of the cartridge frame 63. This lock member 71 is formed with an arm portion 71*a* exhibiting elasticity and an engaging portion 71*b*. On the other hand, an engaging recessed portion 64*t* serving as an engaging portion is formed in a predetermined position of the side wall 64*e* of the shutter 64. With this contrivance, in the state where the shutter is closed, the engaging portion 71*b* engages with the engaging recessed portion 64*t*, and the shutter 64 is locked in the closed state so as not to open carelessly.

Then, when mounting the developing cartridge D into the printer body 30, the lock is automatically released, and the shutter 64 opens.

Note that a circular hole 64*u* is formed in the side wall 64*e* of the shutter 64, and a semicircular protrusion 63*d* is provided in a position, corresponding thereto, of the side wall 63*h* of the developing unit. Therefore, in the state where the shutter 64 is closed, the circular hole 64*u* is fitted in the semispherical protrusion 63*d*, and hence, as discussed above, even when the lock of the shutter 64 is released, it never happens that the developing cartridge D rotates to an unstable position with respect to the shutter 64.

Herein, the construction of the principal portion in the embodiment wherein the present invention is worked is described in greater detail.

As shown in FIG. 8, the shutter is constructed such that the circular hole 64*a* formed in an essential portion of one side wall 64*e*, in the longitudinal direction, of the shutter 64, is rotatably engaged with the protrusion 63*c* provided at one edge, in the longitudinal direction, of the developing cartridge D, and the circular hole 64*a* in the other side wall 64*f* is rotatably engaged with the protrusion 63*g* provided at the other edge, in the longitudinal direction, of the developing cartridge D. In the shutter 64, a cover portion 64*g* is formed between the side walls 64*e*, 64*f*.

The cover portion 64*g* extends in the longitudinal direction in a circular-arc section with the protrusion 63*g* being centered, which is secured to a side cover 63E and the protrusion 63*c* integral with a side cover 63D. The shutter 64 remains open as shown in FIG. 6 in the state where the developing cartridge D is inserted into the printer body 30, and remains close so as to cover the developing roller 12 as illustrated in FIG. 7 in the state where the cartridge D is detached from the printer body 30. The shutter 64 is opened and closed by interlocking the shutter 64 with cartridge mounting portions 14*y*, 14*m*, 14*c*, 14*b* of the rotary unit 11 by the operation of attaching and detaching the developing cartridge D to and from the rotary unit 11. Further, when in a possible-of-development state where the developing cartridge D is inserted into the printer body 30, i.e., when the shutter 64 is opened, an aperture portion 63*b* (see FIG. 8) for making the developing roller 12 exposed serves as an inside region defined by the developing blade 16 shown in FIG. 4, the developing member support frame 63A and the side covers 63D, 63E shown in FIG. 6. A flexible seal (a leakage preventing member) 49 is stuck to a front surface 63A*u*2 of the developing member support frame 63A. The flexible seal 49 extends in the longitudinal direction to cover a developing action area so as to exceed the developing action area of the developing roller 12 as shown in FIG. 6. To be specific, both edges of the flexible seal 49 extend up to positions overlapped with spacer rollers 12*a*, 12*b*, and one end 49*a* in the lateral direction thereof is in close proximity to the photosensitive drum 1 so that the toner images formed on the photosensitive drum 1 can pass through. The other end 49*b* in the lateral direction thereof is, in the state where the shutter 64 is opened, pres-fitted to a shutter internal surface 64*i* at an edge of an open end 64*h* of the shutter 64. Herein, the flexible seal 49 prevents the toners from leaking out of the cartridge frame 63, and further one end 49*b* of the flexible seal 49 is pressfitted to the shutter internal surface 64*i* at the edge of the open end 64*h* of the shutter 64, whereby even when there exist the floating toners scattered from the developing roller 12, the floating toners do not move around to an external wall surface of the cartridge frame 63.

Figure 9:
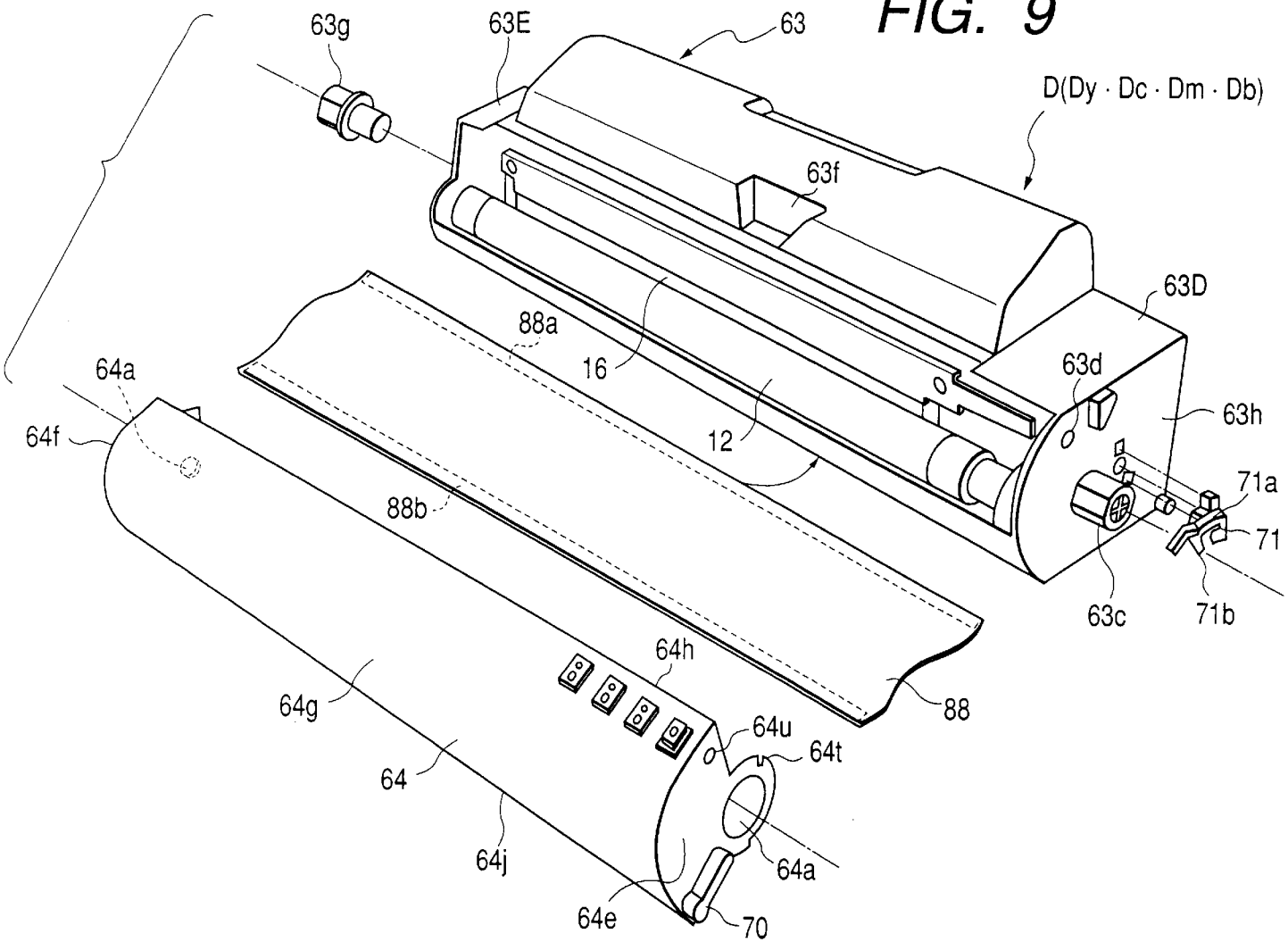
FIG. 9 is an exploded perspective view showing the developing cartridge in an embodiment 1 of the present invention.
Figure 11:
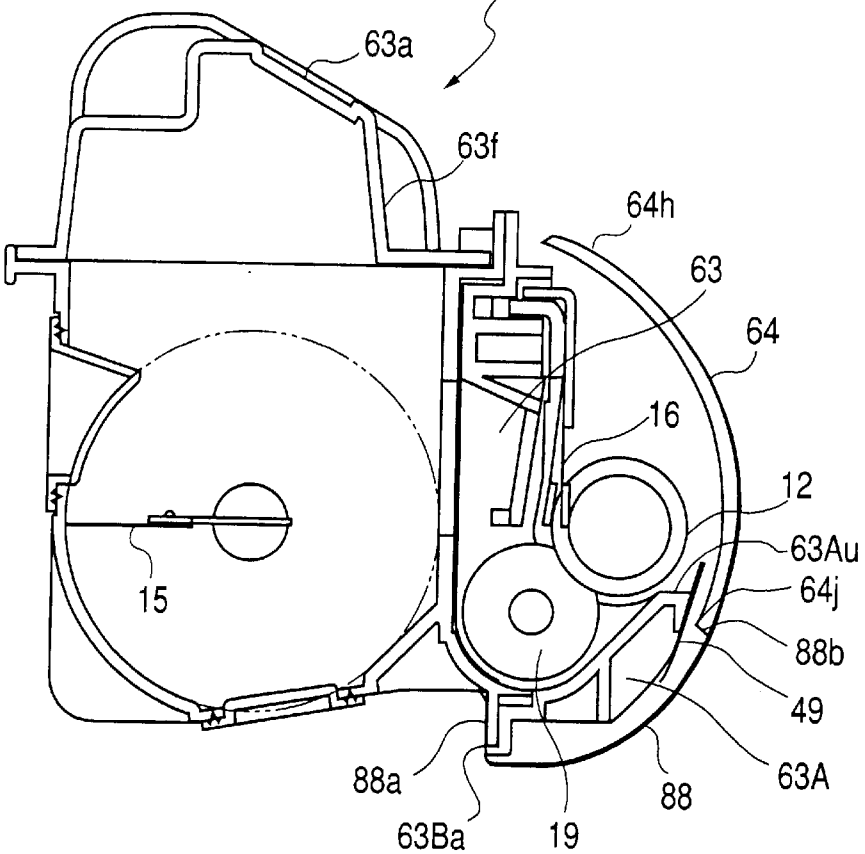
FIG. 11 is a vertical sectional view showing the developing cartridge in the embodiment 1 of the present invention.

Now, the thus constructed developing cartridge D in the embodiment 1 is, as shown in FIG. 9, characterized by providing a flexible member 88 so as to bridge the edges of the cartridge frame 63 and the shutter 64. Then, as illustrated in FIG. 11, when closing the shutter member 64, a one-end side 88*a* of the sheet member 88 in the lateral direction is stuck to a flange portion 63B*a*, provided on the lower side, of the cartridge frame 63 along the longitudinal direction enough to attain such a state that the sheet member 88 can be expanded, and an other-end side 88*b* is stuck to an outer peripheral surface of a rear edge 64*j* of the shutter 64.

A length, along the outside of the support frame 63A, between the front surface 63A*u* of the developing member support frame 63A and the flange 63B*a*, is substantially half of a length along a width of the shutter 64. Then, a width of the sheet member 88 is substantially half of the length along the width of the shutter 64, including some allowance.

Figure 10:
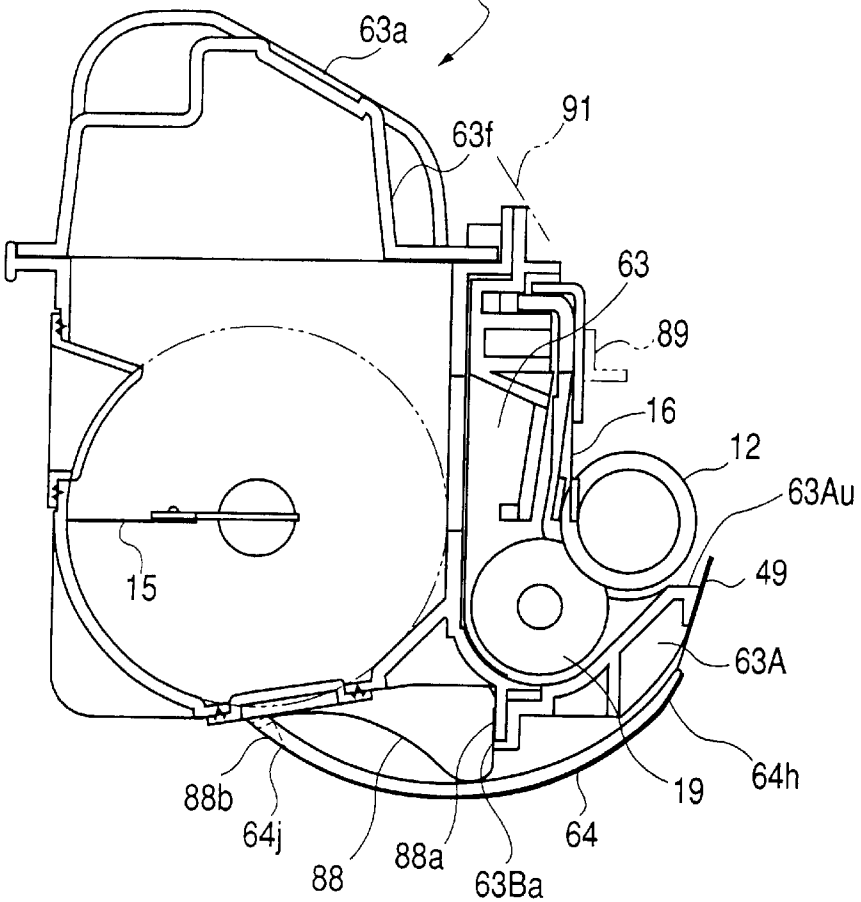
FIG. 10 is a vertical sectional view showing the developing cartridge in the embodiment 1 of the present invention.

In the construction described above, when in the state where the developing cartridge D is inserted into the printer body 30, i.e., when in the state the developing cartridge D is capable of developing, as shown in FIG. 10, the shutter 64 is in the openstate, at which time the sheet member 88 is in a state of being folded between the shutter 64 and a lower portion of the cartridge frame 63. On the other hand, when the developing cartridge D is detached from the printer body 30, as shown in FIG. 11, the shutter 64 is set in a state of being closed to cover the developing roller 12. At this time, the shutter 64 being closed, the sheet member 88 is so constructed as to cover the developing member support frame 63A exposed to the outside of the shutter 64 and also the flexible seal 49 stuck to this frame. Accordingly, if the floating toners are adhered to the exposed portions (which are the developing member support frame 63A and the flexible seal 49 stuck thereto) of the cartridge frame 63 when the developing cartridge D is in the developing position within the printer body 30, the seal member 88 is also constructed to cover the toneradhered portions of the cartridge frame 63 when the developing cartridge D is detached from the printer body 30. It therefore never happens that the portions of the developing cartridge D which are contaminated due to the adhesion of the toners are exposed.

Embodiment 2

Figure 12:
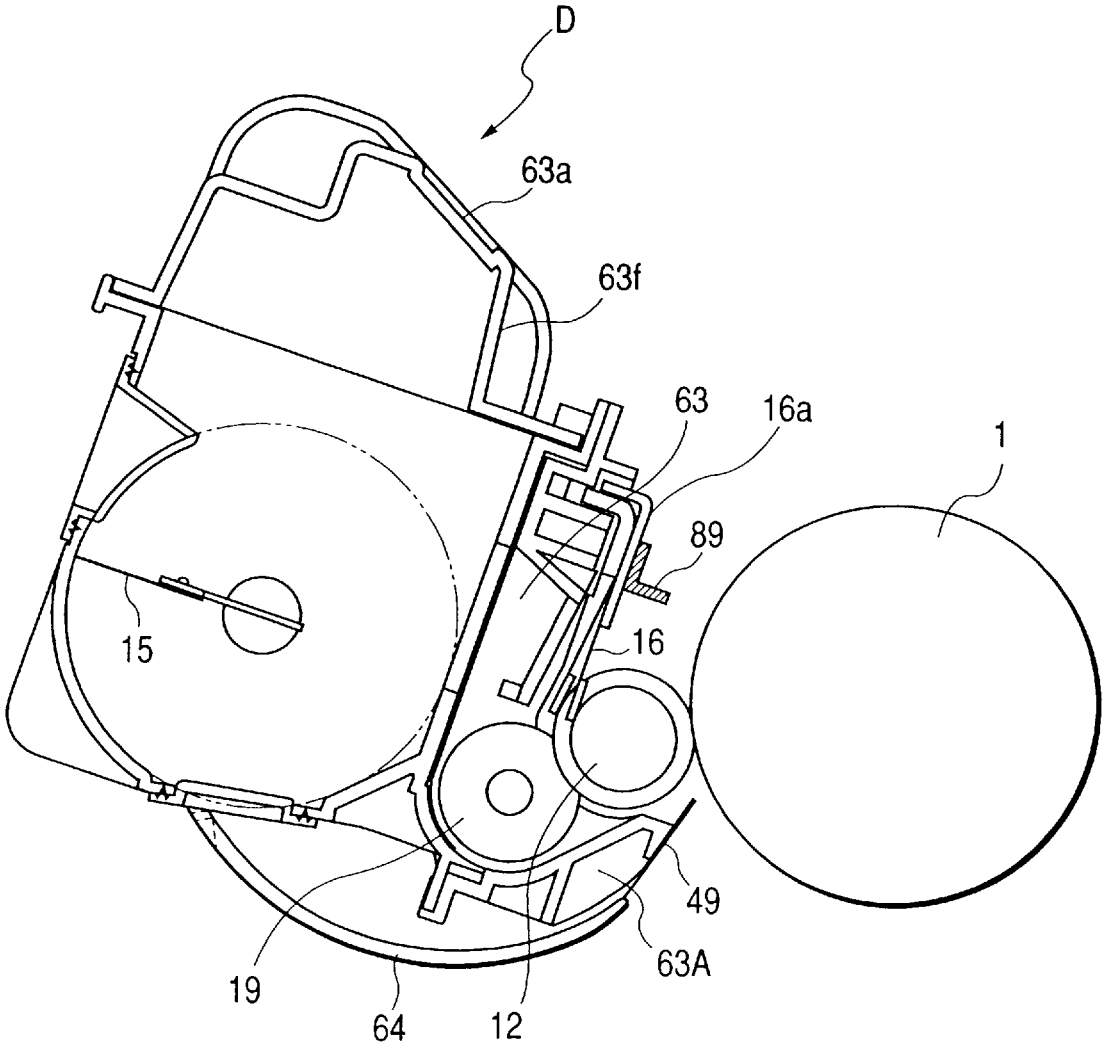
FIG. 12 is a vertical sectional view showing the developing cartridge in an embodiment 2 of the present invention.
Figure 13:
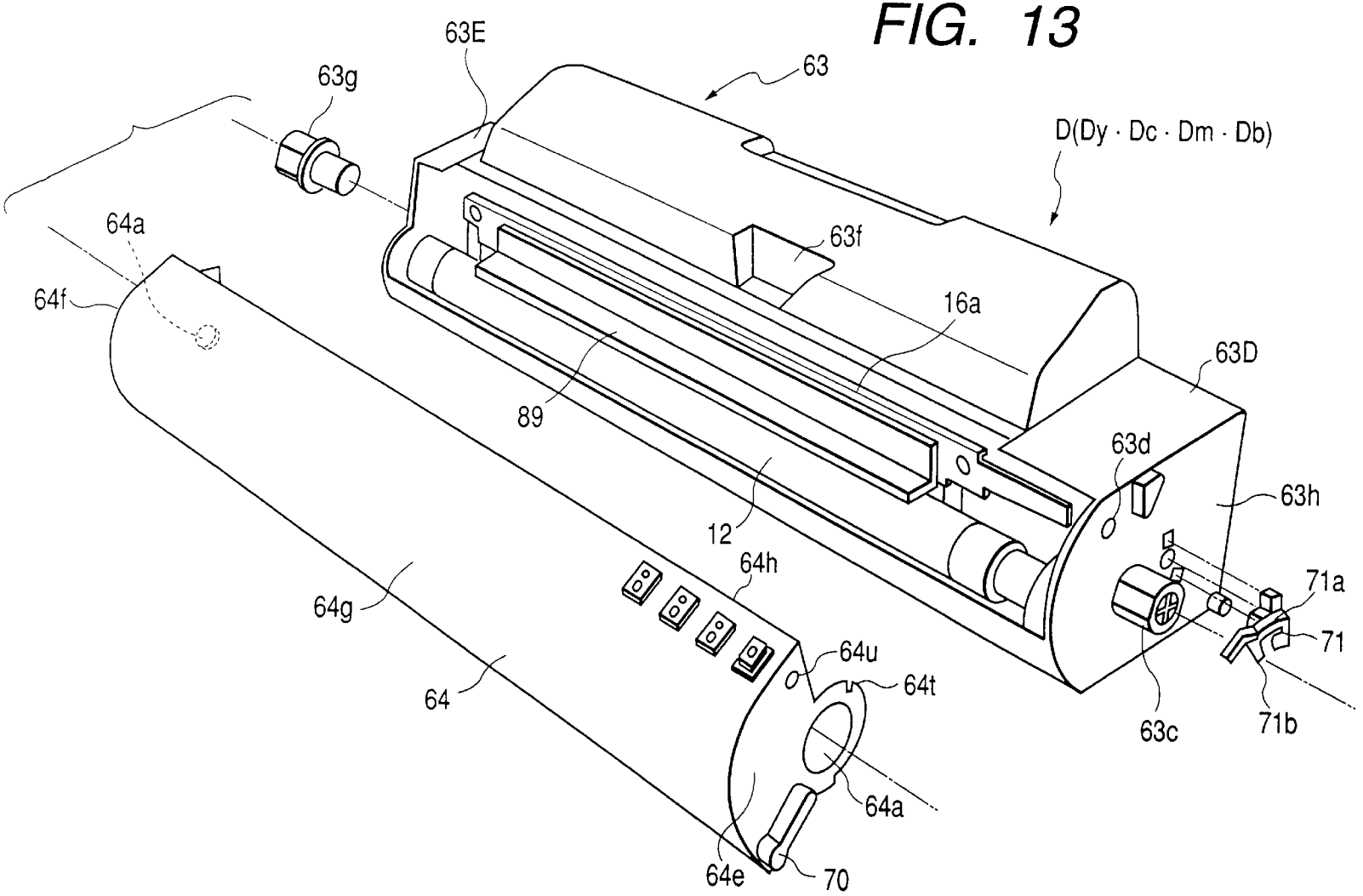
FIG. 13 is an exploded perspective view showing the developing cartridge in the embodiment 2 of the present invention.

Next, an embodiment 2 of the present invention will be discussed with reference to FIGS. 12 and 13.

Note that the portions having the same constructions and performing the same functions as those in the embodiment 1 discussed above, are marked with the same numerals, of which the explanation is omitted.

The embodiment 1 discussed above has dealt with the preventive construction in the case of the floating toners being adhered to the exposed portions of the cartridge frame 63 and to the flexible seal 49 stuck to the frame 63 when the developing cartridge D is in the developing position within the printer body 30. Within the printer body 30, however, the rotary unit 11 rotationally moves about the shaft while holding the developing cartridge D, and it might therefore be considered that the floating toners are adhered to the knob recessed portion 63*f* for holding the developing cartridge D disposed upstream of the developing roller 12.

The embodiment 2 of the present invention is constructed to prevent the floating toners from being adhered to the knob recessed portion 63*f* for holding the developing cartridge D. Based on this construction, as shown in FIG. 12, when the developing cartridge D is in the developing position within the printer body 30, a cutoff plate (a regulating member) 89 for cutting off a flow of the floating toners is provided on the surface of a sheet metal 16*a* to which the developing blade 16 disposed upstream thereof is fixed so that the cutoff plate 89 extends toward the photosensitive drum 1 in a sectional direction. Further, the cutoff plate 89, as illustrated in FIG. 13, extends on the sheet metal 16*a* in the longitudinal direction of the developing roller 12. Accordingly, the cut-off plate 89 is covered with the shutter cover 64*g* together with the developing means in the state where the shutter 64 is closed, and is exposed together with the developing means in the state where the shutter 64 is opened.

In the construction described above, even when the floating toners are likely to be adhered to the knob recessed portion 63*f* provided upstream in the developing position of the cartridge frame 63 in the developing process of the developing cartridge D or in the rotationally moving process thereof, the cut-off plate 89 which is provided, upstream in the moving direction, on the peripheral surface of the exposed-to-the-outside portion of the developing roller 12, cuts off the flow of the floating toners, thereby making it feasible to prevent the cartridge knob recessed portion 63*f* from being contaminated.

Embodiment 3

Next, an embodiment 3 of the present invention will be discussed with reference to FIGS. 14 and 15.

Note that the portions having the same constructions and performing the same functions as those in the embodiment 1 discussed above, are marked with the same numerals, of which the explanation is omitted.

The embodiment 3 of the present invention shows the other embodiment which is constructed to prevent the floating toners from being adhered to the knob recessed portion 63*f* for holding the developing cartridge D, different from what has been discussed above. As explained above, the developing cartridge D is pushed to be inserted into the printer body 30 in such a way that the guide rib 70 provided on the side surface of the shutter 64 of the developing cartridge D is aligned with the cartridge guide 59*f* existing on the internal wall of the rotary unit 11 of the main body shown in FIG. 2. Then, the knob recessed portion 63*f* formed integrally in the cartridge frame 63A of the developing cartridge D is pressed by hand in a direction of an arrow a, with the result that only the developing unit d rotates while the shutter 64 is fixed to the rotary unit 11, and the developing roller 12 appears, thus becoming the possible-of-development state. On this occasion, the knob recessed portion 63*f* for holding the developing cartridge D is, as illustrated in FIG. 14, covered with protection cover member 90 (90*y*, 90*m*, 90*c*, 90*b*) provided respectively for each developing cartridge mounting portion 14 of the rotary unit 11. Herein, the protection cover member 90 is previously provided for preventing the floating toners from being adhered to the developing cartridge D when in the developing process.

Figure 14:
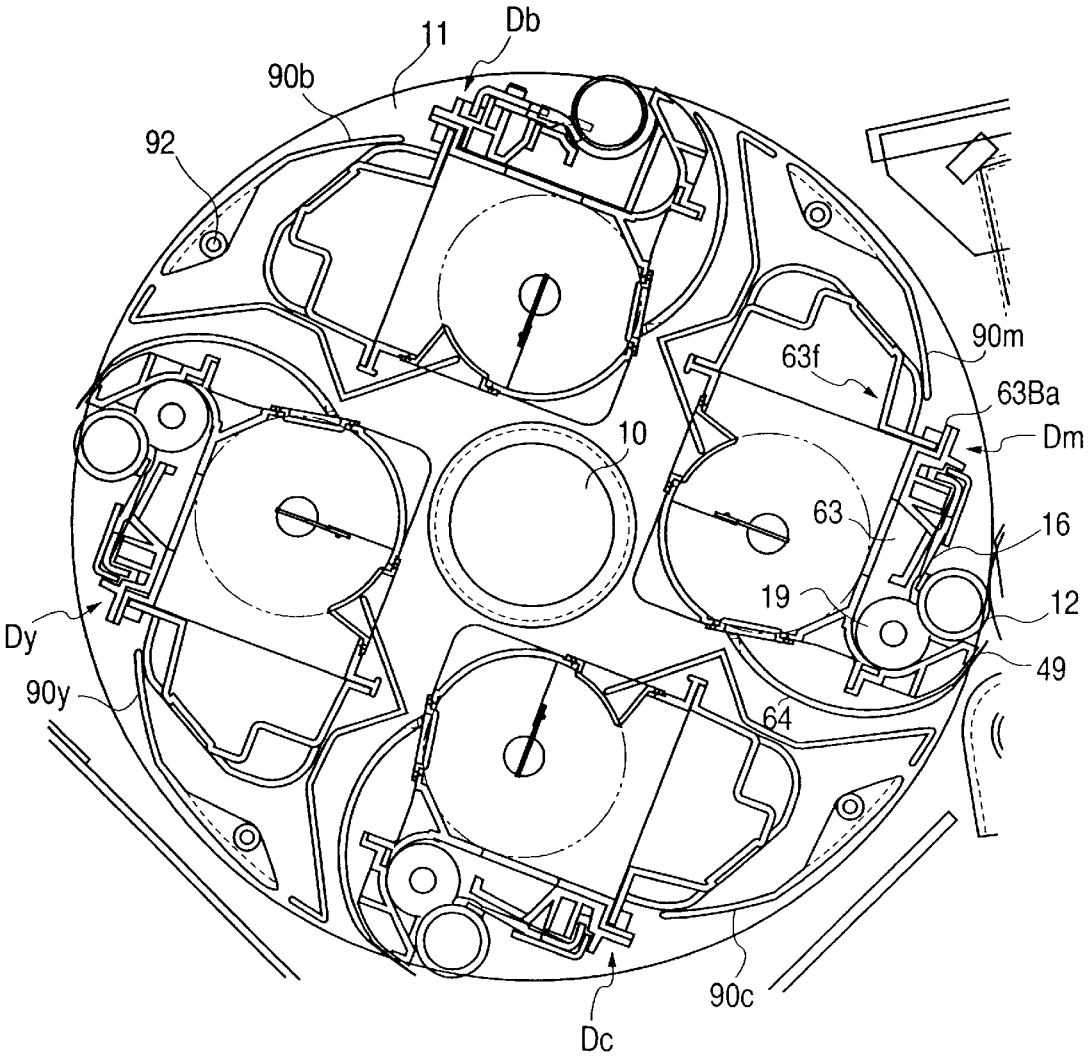
FIG. 14 is a front sectional view showing a rotary unit for carrying out the present invention.

The protection cover member 90 is, exemplifying the protection cover 90*b* in FIG. 14, pivoted to the rotary unit 11 by a pin 92. When the developing cartridge mounting portion 14 of the rotary unit 11 comes to a position of the developing cartridge insertion port 17, this mounting portion 14 can be rotated enabling it to open. When the developing cartridge mounting portion 14 exists outside of the developing cartridge insertion port 17, the edge portion thereof is biased toward the developing cartridge D.

Figure 15:
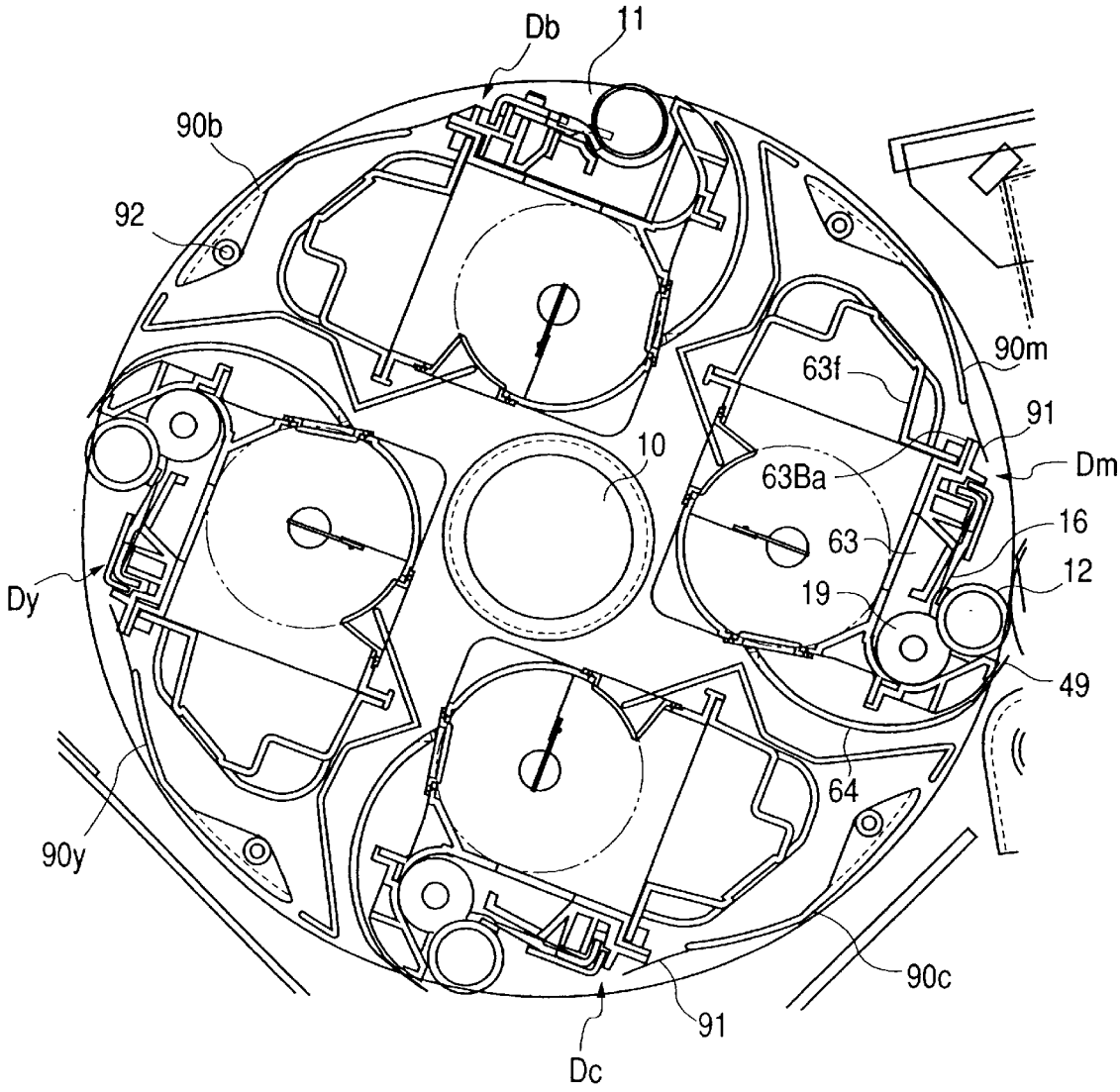
FIG. 15 is a front sectional view showing the rotary unit in an embodiment 3 of the present invention.

The embodiment 3 of the present invention has, as illustrated in FIG. 15, such a construction that a sheet member 91 is stuck, along the longitudinal direction of the developing roller 12, to the edge portion of the protection cover member 90 in the lateral direction. The sheet member 91 extends in the longitudinal direction to cover the developing action region, corresponding to the developing action region of the developing roller 12.

According to the present construction, even when the floating toners are likely to spread into the cartridge knob recessed portion 63*f* formed integrally in the cartridge frame 63 when in the developing process of the developing cartridge D or the rotationally moving process thereof, the sheet member 91 stuck to the protection cover member 90 is tightly closed in contact with the flange portion 63B*a* so as to cover the cartridge knob recessed portion 63*f*, and it is therefore feasible to prevent the toners from spreading into the cartridge knob recessed portion 63*f*.

As discussed above, in the developing cartridge, attachable to and detachable from the electrophotographic image forming apparatus body, for developing the latent image formed on the electrophotographic photosensitive body, the sheet member is provided to cover a part of the cartridge frame when the shutter comes to the cover position along the longitudinal direction of the developing unit. With this contrivance, even if the floating developers are adhered to the exposed portion of the cartridge frame when the developing cartridge is in the developing position within the image forming apparatus, the sheet member is constructed to cover the developer-adhered portion of the cartridge frame on the occasion of detaching the developing cartridge from the image forming apparatus body. It therefore never happens that the portion, contaminated due to the toner adhesion, of the developing cartridge is exposed.

Further, the cutoff plate is provided on the upstream side in the moving direction of the peripheral surface of the developing unit. With this contrivance, even if the floating developers are likely to be adhered to the cartridge knob portion formed integrally in the cartridge frame when in the developing process of the developing cartridge or the rotationally moving process thereof, the cutoff plate provided on the upstream side of the developing means cuts off the flow of the developers floating upstream of the developing means, whereby the cartridge knob portion can be prevented from being contaminated.

Moreover, in order to protect the cartridge knob portion formed integrally in the cartridge frame when mounting the developing cartridge, the sheet member is stuck in the longitudinal direction of the developing means to the edge portion of the protection cover member in the lateral direction which is provided within the apparatus body. With this construction, when in the developing process of the developing cartridge or the rotationally moving process thereof, even if the floating developers are likely to spread to the cartridge knob portion formed integrally in the cartridge frame, the sheet member stuck to the protection cover member is tightly closed to cover the cartridge knob portion, whereby the developers can be prevented from spreading to the cartridge knob portion.

Accordingly, it never happens that the user carelessly touches the developers when replacing the developing cartridge with the result that the hand or the clothes are contaminated.

What is claimed is:

1. A developing cartridge attachable to and detachable from a main body of an image forming apparatus comprising:

a cartridge frame;

developing means for developing a latent image formed on an image bearing member;

a shutter member supported by said cartridge frame, said shutter member movable between a covering position for covering a portion exposed from said cartridge frame of said developing means, and a retreat position retreated from the covering position; and a sheet member, being flexible and interlocking with said shutter member, said sheet member covering a part of said cartridge frame when said shutter member moves to the covering position.

2. A developing cartridge according to claim 1, wherein said sheet member is positioned between said cartridge frame and said shutter member when said shutter member moves to the retreat position.

3. A developing cartridge according to claim 2, wherein one end of said sheet member is connected to said cartridge frame, and the other end thereof is connected to said shutter member.

4. A developing cartridge according to claim 1, further comprising:

a leakage preventive member for preventing a leakage of a developer, wherein said sheet member covers said leakage preventive member when said shutter member moves to the covering position.

5. A developing cartridge according to claim 4, wherein when said developing cartridge is mounted into the main body of said apparatus and said shutter member moves to the retreat position, one end of said leakage preventive member is provided in the vicinity of said image bearing member, and the other end thereof contacts an internal surface of said shutter member.

6. A developing cartridge attachable to and detachable from a main body of an image forming apparatus comprising:

a developer bearing member for bearing a developer supplied to an image bearing member;

a regulating member for regulating a floating developer, said regulating member provided more upstream in a rotating direction of said developer bearing member than a developing position, when said developing cartridge is mounted into the main body of said apparatus;

a cartridge frame; and a shutter member supported by said cartridge frame, wherein said shutter member is movable between a covering position for covering a portion exposed from said cartridge frame of said developer bearing member, and to a retreat position retreated from the covering position, and covering said regulating member when moving to the covering position.

7. A developing cartridge according to claim 6, further comprising:

a knob for holding when mounting said developing cartridge into the main body of said apparatus, wherein said regulating member is provided in closer proximity to said developer bearing member than said knob.

8. A developing cartridge according to claim 6, further comprising:

a layer thickness regulating member for regulating a layer thickness of the developer on said image bearing member, wherein said regulating member is provided on said layer thickness regulating member.

9. An image forming apparatus comprising:

an image bearing member;

a mounting portion provided in a main body of said image forming apparatus and adapted for mounting a cartridge detachably attachable to the main body of said image forming apparatus said cartridge including a developer bearing member for bearing and conveying a developer to develop an electrostatic image formed on said image bearing member with the developer; and a cover member for covering a gripper portion of said cartridge from said developer bearing member when said cartridge is mounted on said mounting portion.

10. An image forming apparatus according to claim 9, wherein said cover member includes a sheet member, and said sheet member abuts against a frame of said cartridge when said cartridge is mounted on said mounting position.

11. An image forming apparatus according to claim 9, wherein a plurality of said mounting portions are provided and rotatable about an axis.

12. An image forming apparatus according to claim 9, wherein said image bearing member is provided on the main body of said image forming apparatus and said cartridge is a developing cartridge.

13. An image forming apparatus according to claim 9, wherein said cover member is provided on the main body of said image forming apparatus.

* * * * *

UNITED STATES PATENT AND TRADEMARK OFFICE

CERTIFICATE OF CORRECTION

PATENT NO. : 6,047,150

DATED : April 4, 2000

INVENTOR(S) : KAZUHIKO KANNO, ET AL.

It is certified that error appears in the above-identified patent and that said Letters Patent is hereby corrected as shown below:

COLUMN 3:

Line 26, "details." should read --detail.--.

COLUMN 4:

Line 32, "pressfitted" should read --press-fitted--.

COLUMN 5:

Line 19, "have" should read --has--.

COLUMN 6:

Line 1, "to the" should read --Simultaneously with this process, the bias is applied to the--.

Line 65, "etc" should read --etc.,--.

COLUMN 7:

Line 67, "pres-fitted" should read --press-fitted--.

UNITED STATES PATENT AND TRADEMARK OFFICE

CERTIFICATE OF CORRECTION

PATENT NO. : 6,047,150

DATED : April 4, 2000

INVENTOR(S) : KAZUHIKO KANNO, ET AL.

It is certified that error appears in the above-identified patent and that said Letters Patent is hereby corrected as shown below:

COLUMN 8:

Line 4, "pressfitted" should read --press-fitted--.
Line 31, "openstate," should read --open-state,--.
Line 46, "toneradhered" should read --toner-adhered--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*